US006286347B1

(12) United States Patent
Frolov

(10) Patent No.: US 6,286,347 B1
(45) Date of Patent: Sep. 11, 2001

(54) CLUTCH MECHANISM WITH MOVEABLE INJECTOR RETAINER WALL FOR DOOR LOCK SYSTEM

(75) Inventor: George Frolov, Farmington, CT (US)

(73) Assignee: Harrow Products, Inc., Grand Rapids, MI (US)

( * ) Notice: Subject to any disclaimer, the term of this patent is extended or adjusted under 35 U.S.C. 154(b) by 0 days.

(21) Appl. No.: 09/370,707

(22) Filed: Aug. 9, 1999

(51) Int. Cl.[7] ..... E05B 13/00

(52) U.S. Cl. ..... 70/472; 70/149; 70/189; 70/218; 70/277; 192/71; 192/84.8; 292/DIG. 27

(58) Field of Search ..... 70/188, 189, 222, 70/223, 218, 472, 277, 149, 422, 204, 278.7; 192/71, 84.8; 292/DIG. 27

(56) References Cited

U.S. PATENT DOCUMENTS

| | | | | |
|---|---|---|---|---|
| 4,135,377 | * | 1/1979 | Kleefeldt et al. | 70/264 |
| 4,656,850 | * | 4/1987 | Tabata | 292/DIG. 27 X |
| 4,770,012 | * | 9/1988 | Johansson et al. | 70/278.1 |
| 4,802,353 | * | 2/1989 | Corder et al. | 70/277 |
| 4,820,330 | * | 4/1989 | Lin | 70/277 |
| 4,899,562 | * | 2/1990 | Gartner et al. | 70/277 |
| 4,995,248 | * | 2/1991 | Liu | 70/107 |
| 5,027,629 | * | 7/1991 | Liu | 70/277 |
| 5,044,183 | * | 9/1991 | Neyret | 70/223 |
| 5,136,870 | * | 8/1992 | Gartner et al. | 70/277 |
| 5,475,996 | * | 12/1995 | Chen | 70/279.1 |
| 5,640,863 | * | 6/1997 | Frolov | 70/277 X |
| 5,953,942 | * | 9/1999 | Doucet et al. | 70/149 X |
| 5,992,195 | * | 11/1999 | Huang et al. | 70/149 X |

FOREIGN PATENT DOCUMENTS

| | | | | |
|---|---|---|---|---|
| 685943 | * | 12/1939 | (DE) | 70/149 |

* cited by examiner

*Primary Examiner*—Lloyd A. Gall
(74) *Attorney, Agent, or Firm*—Alix, Yale & Ristas, LLP

(57) ABSTRACT

A door lock system includes a clutch mechanism for a lockset and has particular applicability in conjunction with lever handles. Two coupling assemblies are selectively rotatably coupled by a coupling pin. One coupling assembly is rotatably coupled to the lockset actuator. The other coupling assembly is rotatably coupled to the exterior door handle. A drive assembly includes a motor and employs an injector which has a movable arcuate shoulder and which selectively controls the position of the coupling pin to provide for the locking and unlocking functions.

12 Claims, 8 Drawing Sheets

CLUTCH MECHANISM WITH MOVEABLE INJECTOR RETAINER WALL FOR DOOR LOCK SYSTEM

BACKGROUND OF THE INVENTION

This invention relates generally to security systems which are mounted to a door to provide a latching and locking function. More particularly, the present invention relates generally to lock devices which may be employed with entry control devices to control access through a door.

Locksets which incorporate a lockable latch and/or a dead bolt have long been incorporated into doors. A number of door mounted security systems which employ electronic input such as key pads, contact activatable chips, card readers and other electronic means have also been employed for use in conjunction with the mechanical latching and locking mechanisms.

The recent hardware trends and the Americans with Disabilities Act regulatory requirements for lever handles at both the exterior and interior sides of the door have made some conventional latch/lock set mechanisms vulnerable to mechanical failure. Application of an opening force to lever handles may result in significant larger moments being transferred to the internal mechanical components of the lock set than occur with conventional door knobs. Consequently, the requirement that the lock system mechanical components be able to maintain their functional and structural integrity may be more difficult to achieve under the increased load conditions presented by lever handles. With the advent of the electronic access employed in conjunction with the conventional mechanical-type lockset, the susceptibility to mechanical breakdown and vulnerability to techniques for defeating locking/unlocking operation may also be increased.

SUMMARY OF THE INVENTION

Briefly stated, the invention in a preferred form is a clutch mechanism for a door lock of a type having a lockset with a projectable and retractable lockable latch. The lockset has an actuator for operating the latch. A first coupling assembly operatively connects with the actuator. A second coupling assembly is responsive to rotatable motion applied to a lever handle or other hardware at the exterior side of the door. The clutch mechanism selectively engages the first and second coupling assemblies. The clutch mechanism preferably includes a pin carried by the first coupling assembly in fixed rotatable relationship therewith. The pin selectively engages the second coupling assembly.

An injector disposed in generally fixed rotatable relationship with the lockset forces the pin into engagement with the second coupling assembly. The injector has an arcuate shoulder and is spring biased to both inject the pin and to function as a movable retainer wall to retain the pin in engagement with the second coupling assembly and thereby diminish the vulnerability to improperly returning to the locked condition. The biased relationship also effectively accommodates manufacturing and/or operating inaccuracy in the arcuate path of the coupling pin. A drive assembly for driving the injector between first and second axial positions provides for selectively rotatably engaging the first and second coupling assemblies to selectively lock and unlock the latch from the exterior side.

The second coupling assembly preferably includes a slot which receives the coupling pin. The coupling assemblies are rotatable about a first axis. The coupling pin is slidably displaceable between an engaged and a non-engaged position along a second axis which is generally orthogonal to the first axis. A spring biases the coupling pin to the non-engaged position. The injector shoulder and its biased relationship acts to retain the coupling pin in the engaged position with one end of the pin engaging the arcuate shoulder which functions as a movable self-adjustable retainer wall upon rotating the second coupling assembly. The injector arcuate shoulder thus functions to prevent a loading applied to the inside lever handle from returning the clutch assembly to the locked condition.

An object of the invention is provide a new and improved clutch mechanism for a door lock system.

Another object of the invention is to provide a new and improved clutch mechanism which is capable of efficient and reliable operation under the increased torque demands and various conditions that may be applied to lever handle type actuators.

A further object of the invention is to provide a new and improved clutch mechanism which has less vulnerability to be defeated.

A further object of the invention is to provide a new and improved clutch mechanism which may be efficiently and effectively employed in conjunction with an electronic entry device.

Other objects and advantages of the invention will become apparent from the drawings and the specification.

DETAILED DESCRIPTION OF THE PREFERRED EMBODIMENT

Figure 1:
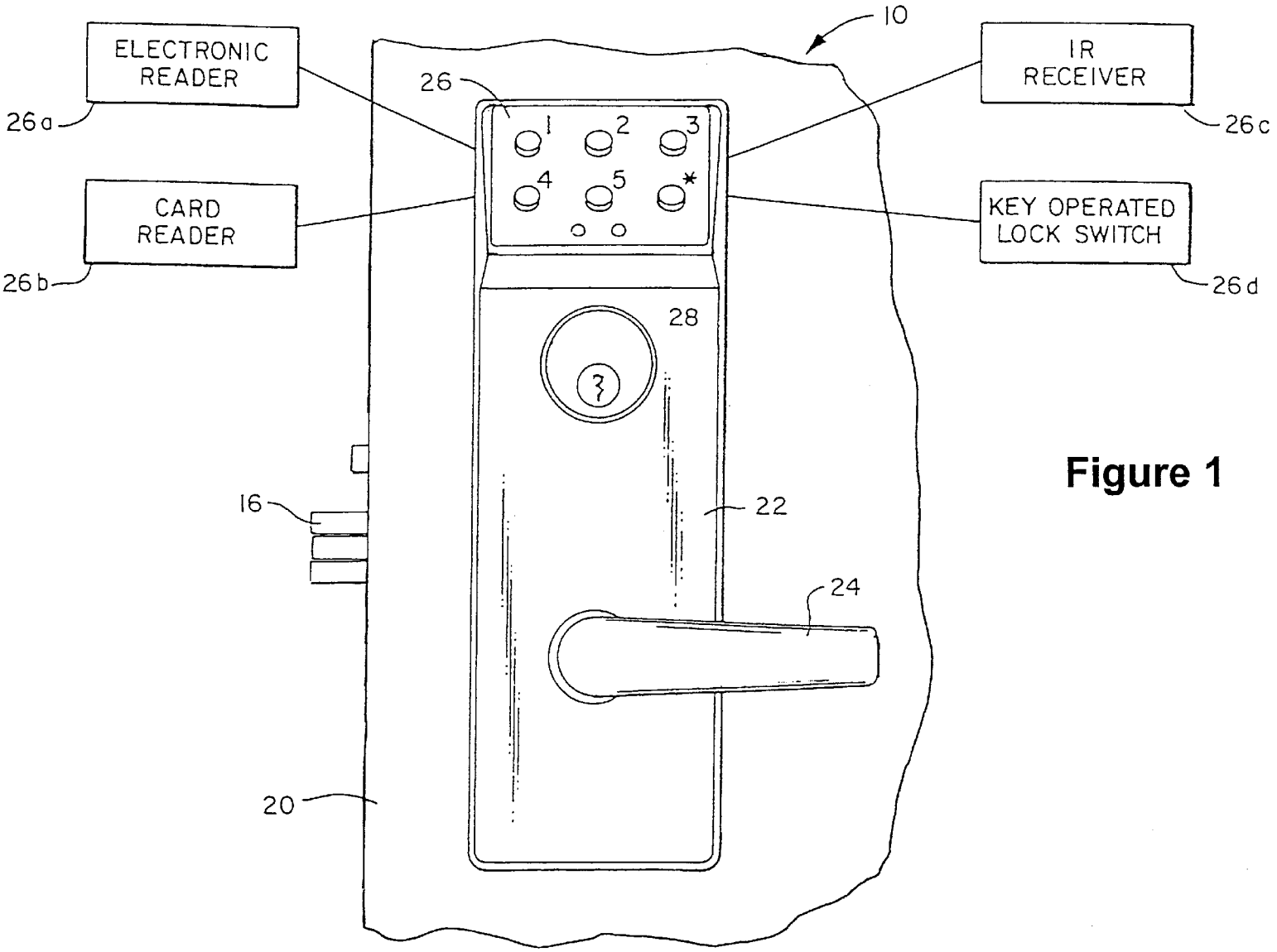
FIG. 1 is a fragmentary frontal view of a door with a door lock system incorporating a clutch mechanism in accordance with the invention, said lock system being illustrated in schematic to illustrate various possible features.

With reference to the drawings wherein like numerals represent like parts throughout the several figures, a door lock system 10 incorporates a clutch mechanism 12 in accordance with the present invention. The lock system includes a lockset 14 which may be a mortise type lockset or other type lockset. The lockset implements a latching function via latch 16 for latching and locking the door 20. Except for the modifications described herein, the lockset may be of any conventional form and function and is of a type wherein the outside operator or handle retracts the latch. The lockset 14 is preferably operated by a cam or actuator arm which interacts with a spindle or spindles rotatably connectable with lever handles at each side of the door for withdrawing the latch.

In an illustrated embodiment, the door lock system employs a frontal escutcheon 22 which is mounted to the exterior side of the door 20. A lever handle 24, which is normally in a generally horizontal position, at the exterior of the door is operable to unlatch the door upon downward angular rotation.

Figure 3:
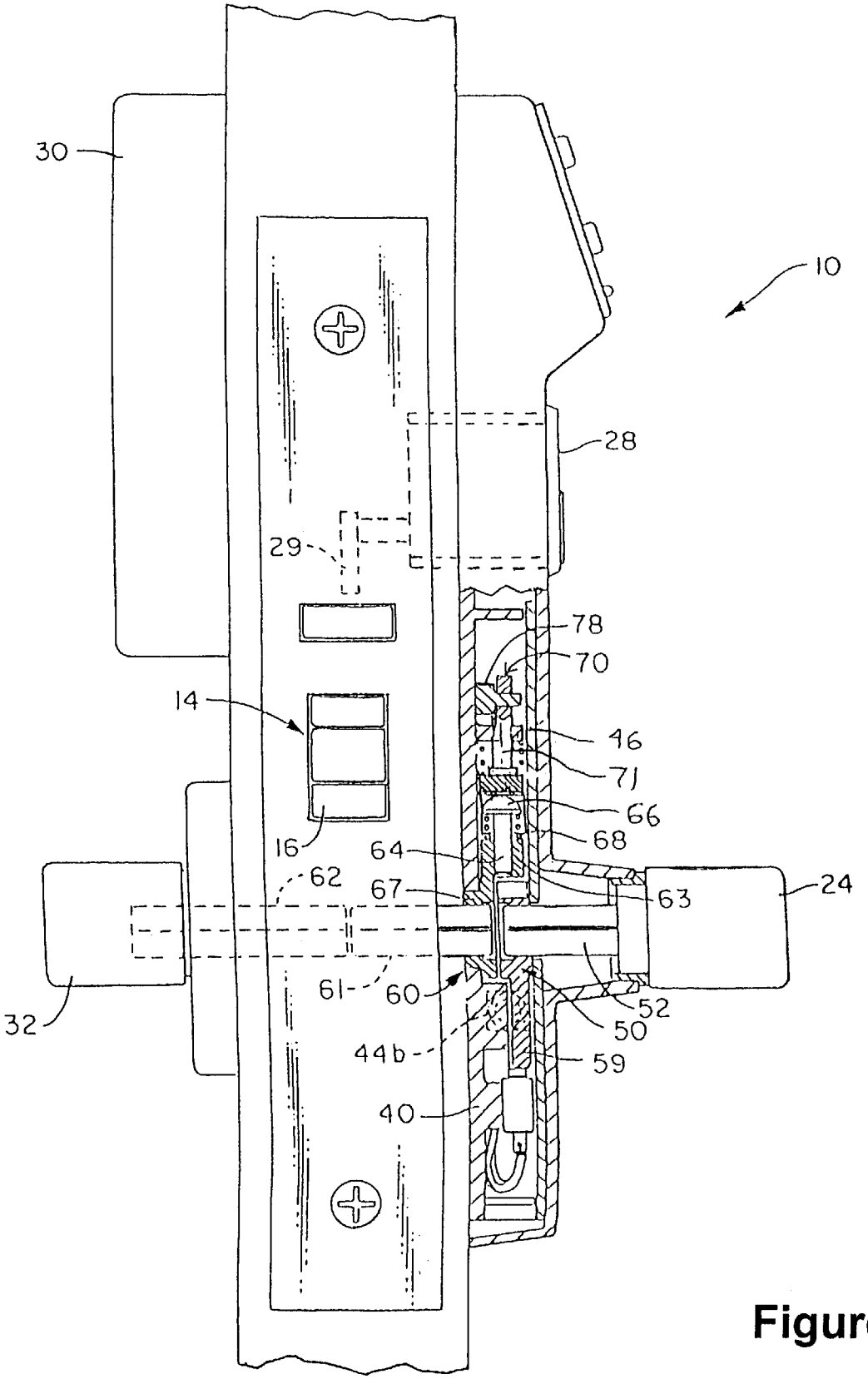
FIG. 3 is a side elevational view, partly broken away, partly in section and partly in phantom, of the door, door lock system and clutch mechanism of FIG. 1 viewed from the left thereof.

With additional reference to FIG. 3, the invention is described in the environment of a conventional door system wherein free egress through the door is permitted from the interior (left in FIG. 3) and the door is controllably secured from the exterior side (right in FIG. 3) by selectively transforming the lever handle 24 to an inoperative mode to effectively disable the lever handle. Access through the door may be obtained via an electronic access control device, which may be a keypad 26, a contact activatable electronic reader 26*a,* a card reader 26*b,* an IR receiver 26*c,* a cylindrical key operated lock switch 26*d* or other electronic device. A key-operated mortise lock 28 which operates a cam mechanism 29 interacting directly with the lockset in a conventional manner to implement a mechanical override function may also be employed.

A control module 30 and an inside lever handle 32 are mounted at the interior side of the door. The inside lever handle 32 also preferably normally assumes a horizontal position and is downwardly rotatable to permit egress through the door.

The clutch mechanism 12 functions to provide the mechanical engagement interface to allow for the proper latching, locking and unlocking functions for the lockset. The clutch mechanism 12 is particularly advantageous in conjunction with door systems which employ lever handles. The invention may also be employed in conjunction with door systems that employ knobs or other hardware.

The clutch mechanism 12 is interposed in the door latching system at the exterior side of the door between the lockset 14 and the lever handle 24. A frame 40 is mounted in fixed disposition at the front of the door and disposed under the escutcheon 22. The frame is configured for mounting various components of the clutch mechanism 12 as described below.

An operator coupling assembly 50 rotatably connects via a spindle 52 with the exterior lever handle 24 and is rotatable therewith. With reference to FIG. 3 actuator coupling assembly 60, which has a conventional form and function, connects via spindle 61 to the lockset actuator. An inner spindle 62 also connects the lockset actuator with the interior lever handle 32 and is rotatable with the lever handle for operating the lockset from the interior side of the door in a conventional fashion. The clutch assembly generally functions to provide selective rotatable engagement between the operator and actuator coupling assemblies as will be described below. The exterior lever handle 24, the interior lever handle 32, the operator coupling assembly 50 and the actuator coupling assembly 60 angularly pivot or rotate about a common axis.

Figure 2:
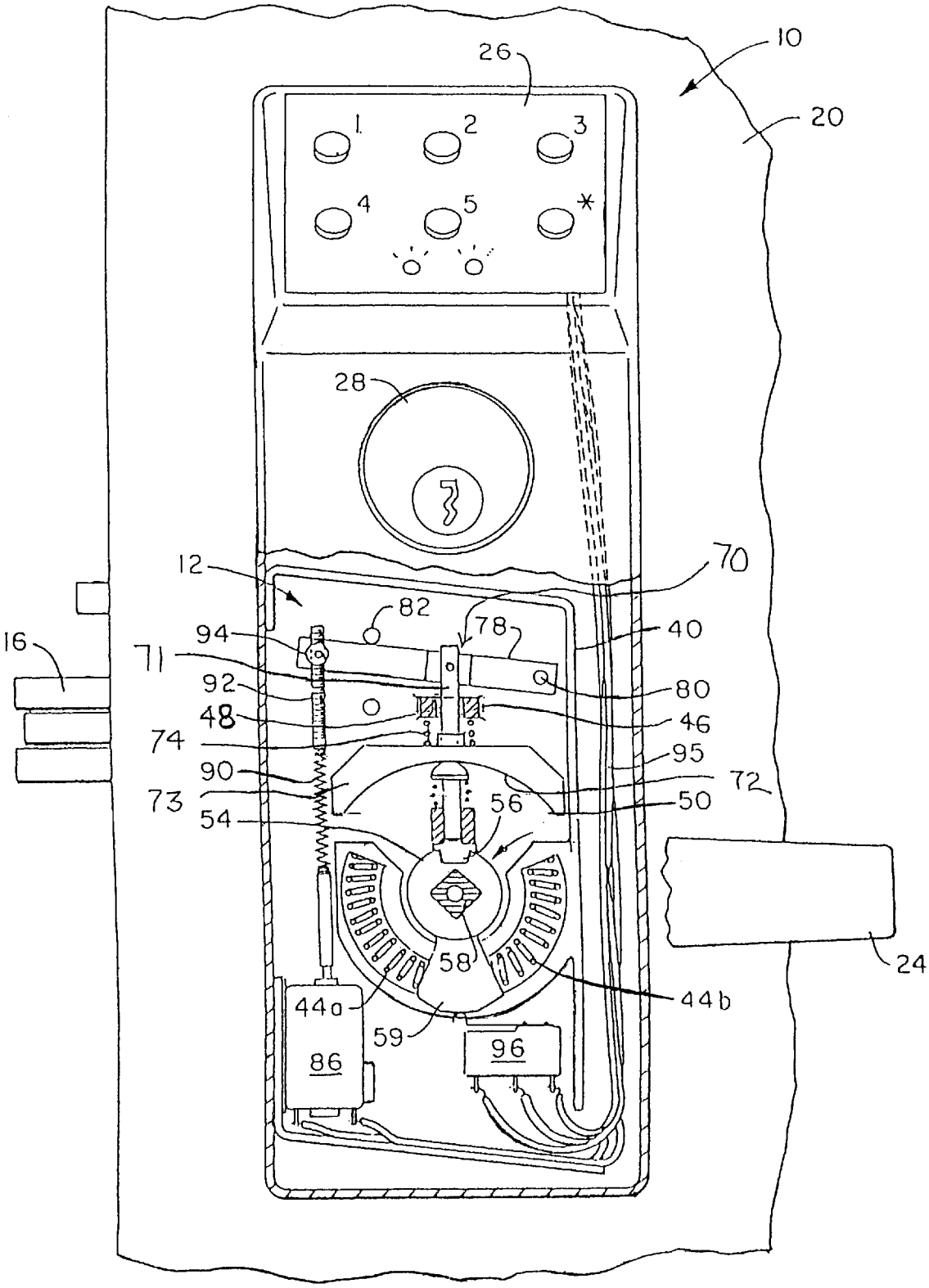
FIG. 2 is a frontal view, partly broken away, partly in section and partly in phantom, of the door, door lock system, and clutch mechanism of FIG. 1.

The operator coupling assembly 50 comprises a rotatable cylindrical coupler 54 which has a peripheral slot 56. The coupler includes a square axial opening 58 for receiving the outer spindle 52. A cam plate 59 extends from the coupler at a diametrically opposed position relative to the slot 56. The fixed frame forms a pair of arcuate recesses 42 for springs 44*a,* 44*b* which bear against the opposed portions of the cam plate 59 to bias the operator coupling assembly to the normal null position of lever handle 24 illustrated in FIGS. 2 and 5.

The frame 40 forms a yoke 46 which receives a sleeve 48. An injector 70 comprises a pivotally mounted rod 71 slidably received in the sleeve for reciprocal axial motion therein. The rod 71 connects at its lower end with a transverse member 73 which defines an arcuate wall or shoulder 72. A spring 74 disposed between one end of the sleeve and the head biases the injector downwardly as viewed in FIGS. 2 and 3. The opposing end of the injector rod is pivotally connected to a drive lever 78 at an intermediate location thereof. The drive lever 78 pivots at one end about a pin 80 which is fixed to the frame. The angular displacement of the drive lever is limited by a pair of stops 82 and 84 which also define the extreme axial limits of the injector 70, and in particular shoulder 72.

The actuator coupling assembly includes a rotatable plate 67 which integrally extends to form a bracket 63 for receiving the coupling pin 64. The distal end on the coupling pin 64 is dimensioned for reception in slot 56. The opposing end of the pin has a head 66. A spring 68 disposed between the head and the bracket upwardly biases the coupling pin. The bias force of spring 68 is less than the bias force of spring 74. The bracket and hence the coupling pin are rotatable in fixed relationship with the plate of the actuator coupling assembly which is rotatably coupled with the lockset actuator.

Figure 4:
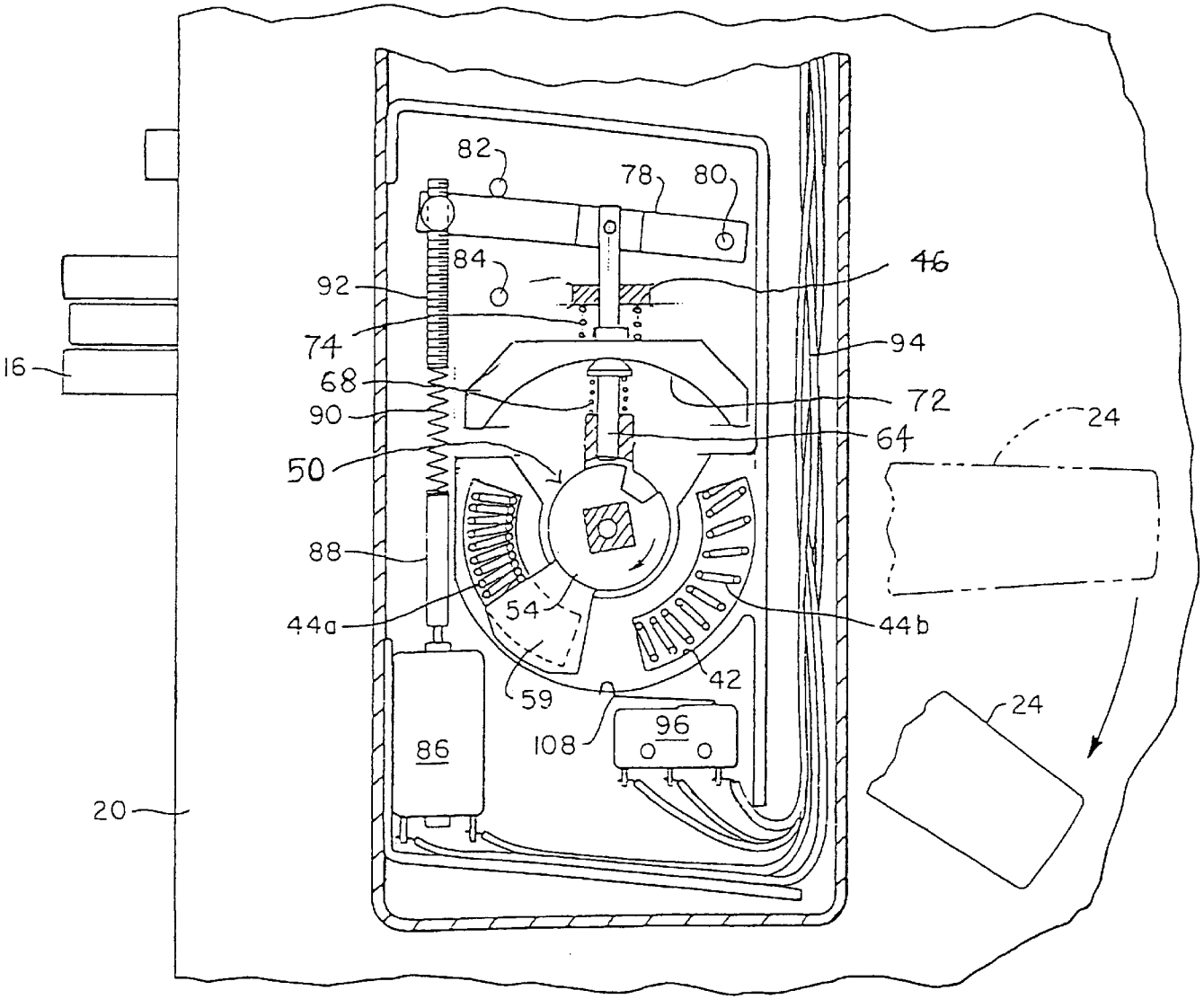
FIG. 4 is a fragmentary frontal view, partly broken away, partly in section and partly in schematic, of the door, door lock system and clutch mechanism of FIG. 1 illustrating a locked mode.

With reference to FIGS. 2 and 4–7, a bidirectional DC motor 86 is mounted to the frame. The motor drives a shaft 88 which connects via a spring shaft 90 with a drive screw 92. The drive screw threads to a drive nut 94 (FIG. 7) mounted to the drive lever 78 to angularly drive the drive lever about pin 80 and hence reciprocate the injector engaged to a drive pin. The spring shaft 90 biases the drive lever against the stop 82 and thereby implements a normally locked configuration for the lock system, as illustrated in FIG. 4.

The entry control device 26 electrically connects via leads 94 and microswitch 96 with the DC motor 86 for operating the clutch mechanism. The operation of the clutch mechanism is sequentially illustrated in FIGS. 4 to 6 which progressively illustrate locked, unlocked/latched and unlocked/unlatched positions, respectively. In the position illustrated in FIG. 4, the entry control 26 is in a locked state and the operator coupling assembly 50 is in a free-wheeling state (rotatable in the central arrow direction) relative to the actuator coupling assembly 60. The exterior lever handle 24 is free to rotate in the direction of the outer FIG. 4 arrow. The coupling pin 64 is upwardly biased to engage the injector 70. For the upper position of the drive lever, the coupling pin 64 does not engage slot 56. The operator coupling assembly 50 is therefore in a limited free-wheeling state relative to the actuator coupling assembly 60. Any motion or torque applied to the outer lever handle simply results in a lost angular rotation of the operator coupling assembly, and the door remains in a locked condition from the exterior side. As best illustrated in FIG. 4, when the lever handle 24 is rotated, spring 44*a* compresses, and upon release of the handle, the spring 44*a* returns the operator coupling assembly 60 to the normal null position (FIGS. 1 and 2) wherein the slot 56 aligns with the end of the coupling pin 64. A substantial downward torque applied to the lever handle 24 is transferred via the cam plate 59 to solid fixed stops 41 (FIG. 7) incorporated into the frame 40 thereby preventing the torque from being transferred to the other vulnerable mechanical components of the door system.

Figure 5:
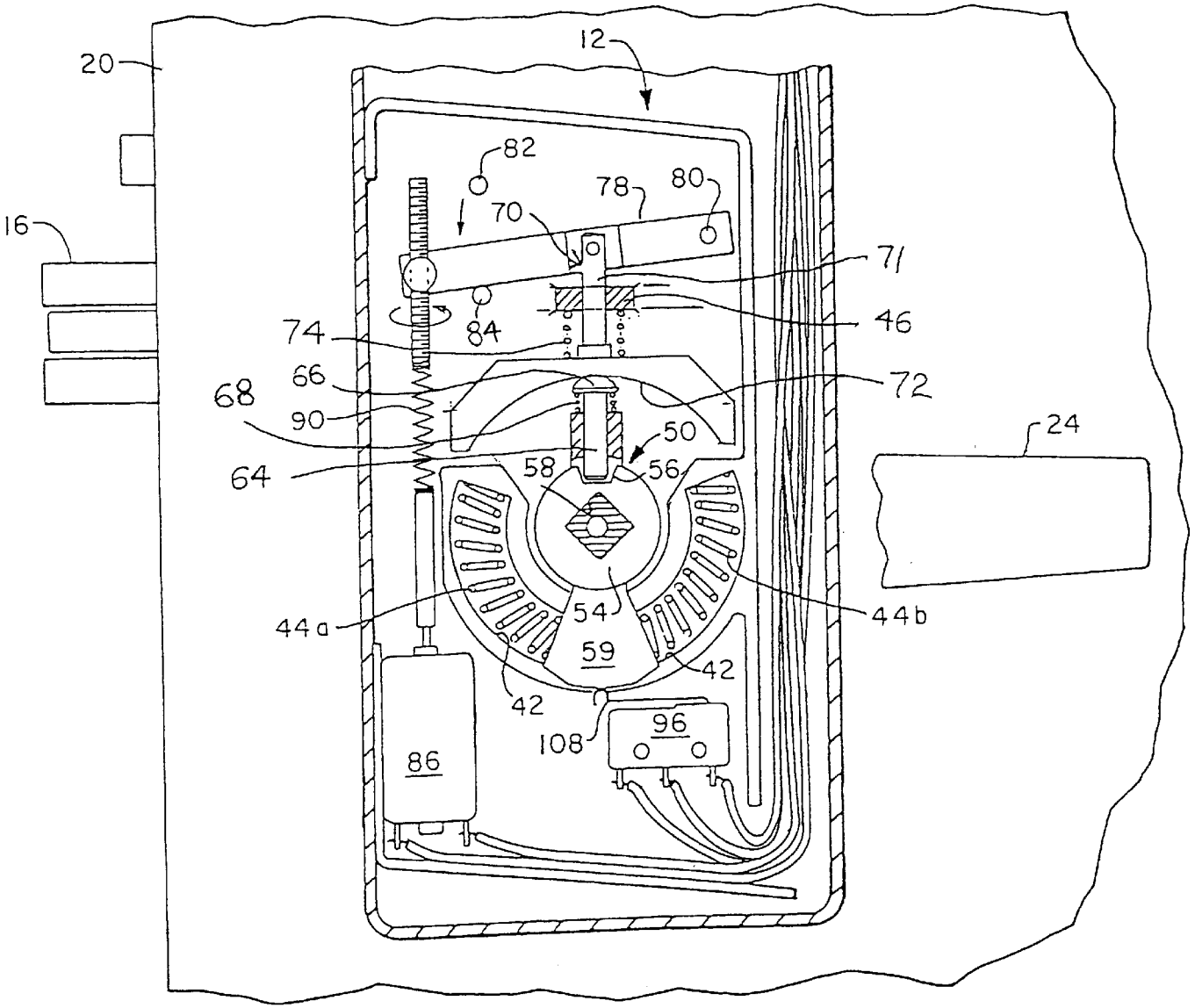
FIG. 5 is a fragmentary frontal view, partly broken away, partly in section and partly in schematic, of the door, door lock system and clutch mechanism of FIG. 1 illustrating an engaged mode prior to unlocking.

When the access control 26 is transformed to an unlocked state by entry of a valid code, card or key, the motor 86 energizes and drives the screw drive 92 to force the drive lever 78 and hence the injector 70 downwardly as indicated by the FIG. 5 arrows. The downward force of the injector overcomes the bias of spring 68. The pin head 66 and shoulder 72 engage to force the distal end of the coupling pin into the slot 56 as illustrated by the arrows in FIG. 5. The motor 86 continues to drive shaft 88 until the drive lever engages the stop 84. The operator coupling assembly 50 and the actuator coupling assembly 60 are now rotatably coupled by pin 64 and hence the lever handle 24 is rotatably coupled to the lockset actuator.

Figure 6:
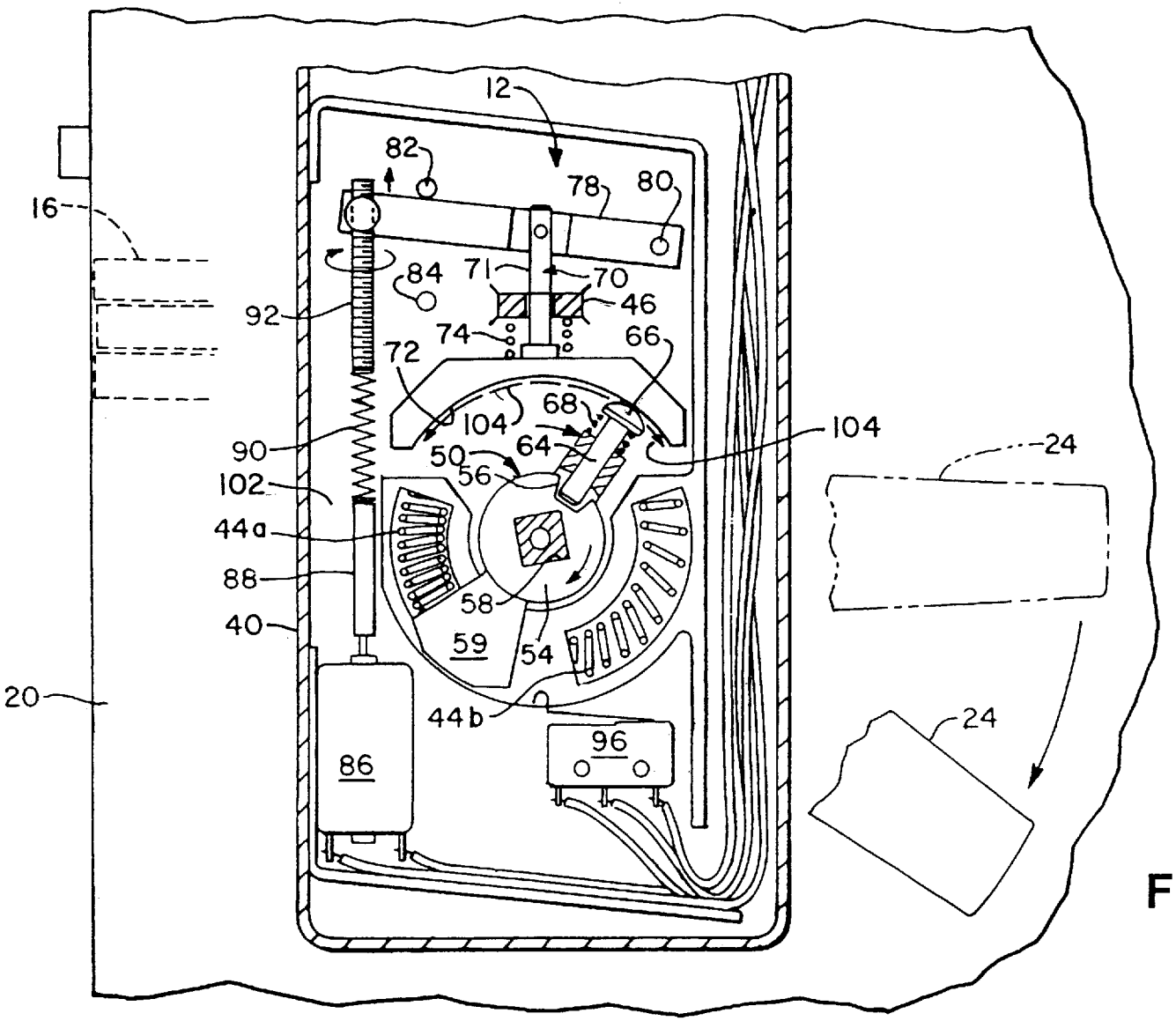
FIG. 6 is a fragmentary frontal view, partly broken away, partly in section and partly in schematic, of the door, door lock system and clutch mechanism of FIG. 1 illustrating an unlocked mode.

With reference to FIG. 6, as the exterior lever handle 24 is downwardly rotated, the coupling pin 64 engages in slot 56 of the outer coupling assembly and consequently the inner coupling assembly now rotates with the outer coupling assembly as indicated by the FIG. 6 arrows. The engagement interface between the head 66 and shoulder 72 aligns and forms a shear rotation gap 104 at the underside of the arcuate shoulder 72 to allow the coupling pin 64 to rotate away from vertical alignment with shaft of the injector 70. The frame defines a cavity 102 to permit rotation of the coupling pin 64 which is captured in the slot 56.

The movable wall defined by the arcuate shoulder 72 of the injector allows for axial movement of the injector and thus movement of the arcuate wall. The coupling engagement of the pin 64 is maintained by the arcuate shoulder 72 which biases downwardly against the top of the pin. The shoulder 72 ensures the coupling engagement to prevent a loading applied to the inside lever handle from allowing the coupling pin to disengage and immediately return to the lock condition. In addition, the biasing of the shoulder provides a continuous self-adjustment feature which accommodates wobble, off-center rotation or slight misalignment of the moving components and accommodates a departure from a precise arcuate path of the coupling pin and associated components. In a preferred form, the arcuate surface 72 subtends or obstructs a substantial angle of, for example, approximately 100° about the axis of the injector rod 71.

The cam 59 of the outer coupling assembly is correspondingly angularly displaced from a trigger arm 108 of the microswitch 96 as the operator coupling assembly 50 rotates. Consequently, the microswitch 96 is actuated to energize the motor in reverse to return the injector 70 to the initial upper position defined by the drive lever 78 engaging stop 82. In addition, upon the displacement of cam 59, the electronics may be temporarily shut off thereby saving power—especially for embodiments (not illustrated) which are battery powered.

The spring shaft 90 functions to self-center the drive lever 78 and self-compensate for any overtravel, undertravel or temporary jamming conditions. Because springs 68 and 74 are in a counterbalanced relationship, any overtravel or undertravel of the spring shaft results in corresponding compression or extension of the spring shaft so that the position of the drive lever will be self-compensated and effectively centered when the motor is reactivated.

The exterior lever handle 24 may be turned downwardly to withdraw the latch since the actuator which actuates the lock set rotates with the inner coupling assembly 60. When the coupling pin 64 is rotatably returned to the null position, the clutch mechanism assumes the FIG. 4 configuration.

Figure 7:
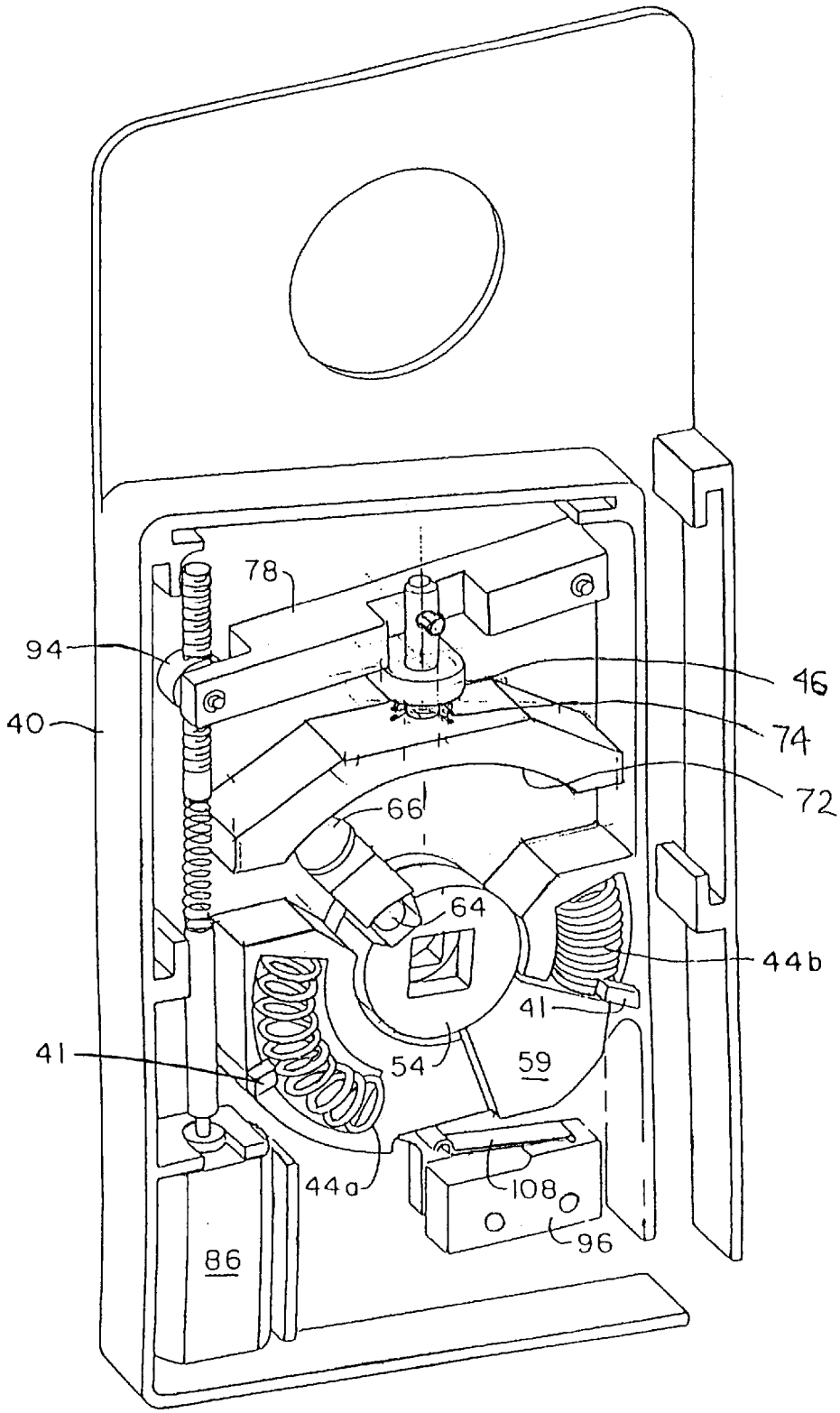
FIG. 7. is an interior perspective view, portions removed, of the clutch mechanism of FIG. 1, illustrating an unlocked mode for an opposite orientation of the lever handle.

Naturally, the clutch mechanism including, for example, the geometry of cavity 102, the position of springs 44*a*, 44*b* and the coupling assemblies rotational geometry, is adapted for use with either a right or a left hinged door as illustrated in FIG. 7.

Figure 8:
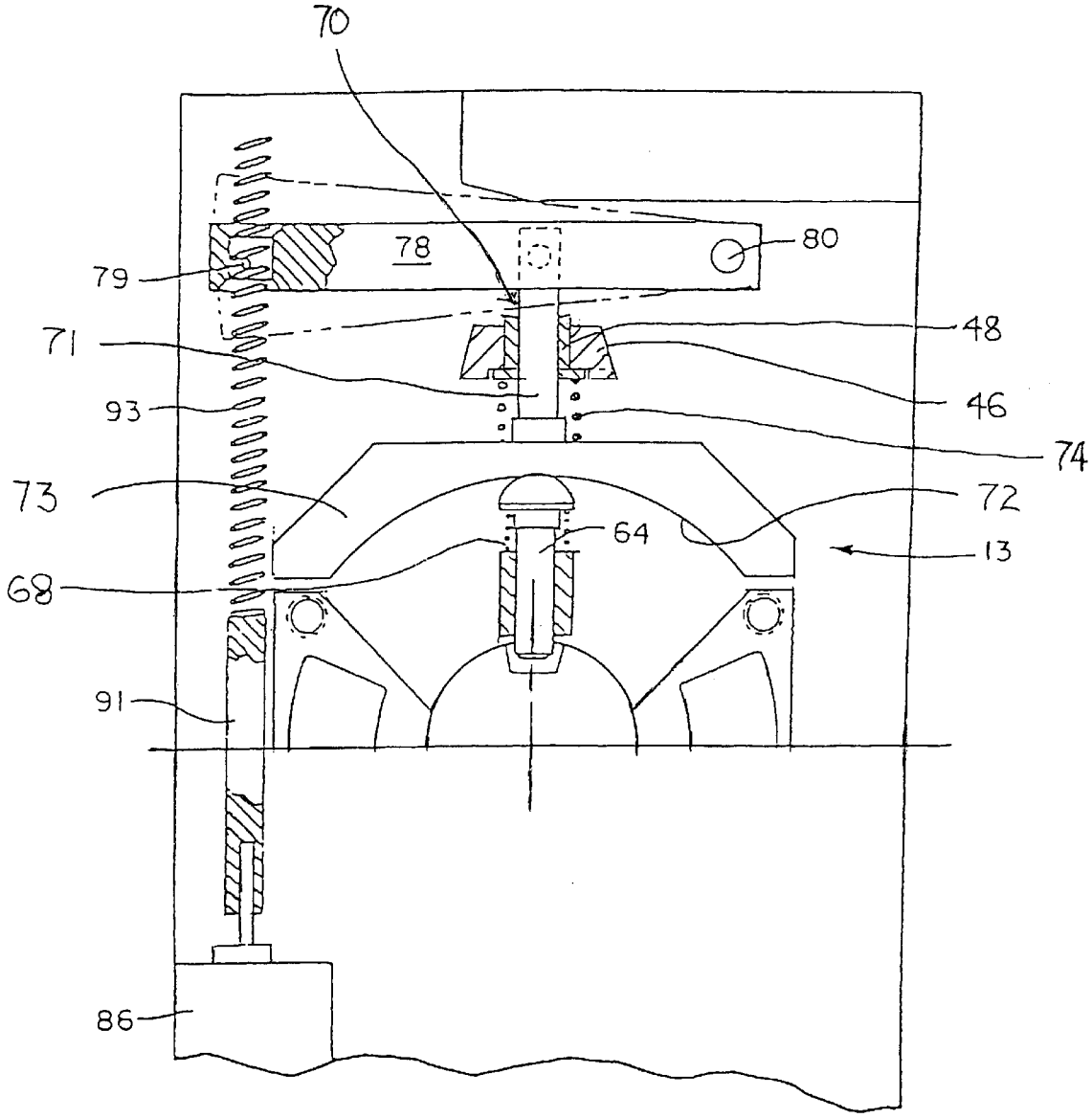
FIG. 8 is an enlarged fragmentary frontal view, partly broken away, partly in section and partly in phantom, of a door lock system incorporating a second embodiment of a clutch mechanism in accordance with the invention.

With reference to FIG. 8 which illustrates another embodiment of a clutch mechanism 13, the spring shaft 91 terminates in a helical spring 93. The spring is pinned to the drive lever 78 by a pin 79. This latter configuration is an alternative to the drive screw 92/drive nut 94 configuration previously described and the clutch mechanism otherwise functions in substantially the same manner as previously described for clutch mechanism 12.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A clutch mechanism for a door having a lockset with a lockable latch and an actuator for operating said latch, said clutch mechanism comprising:

first coupling means comprising a rotatable assembly for selectively translating rotatable motion applied at one side of said door;

second coupling means comprising a rotatable assembly for selectively translating rotational motion applied at one side of said door; and clutch means for selectively engaging said first and second coupling means, said clutch means comprising:

pin means carried by said first coupling means in rotatable relationship with said door for forcing said pin means into engagement with said second coupling means;

injector means comprising a movable wall with a concave arcuate surface engageable against said pin means, said pin means slidably engageable along the concave arcuate surface of said wall; and drive means for driving said injector means between first and second positions to selectively engage said first coupling means in fixed rotational relationship with said second coupling means which permits operation of said latch from said one side, said drive means comprising a motor and a drive link comprising a spring shaft drivable by said motor for axially displacing said injector means.

2. The clutch mechanism of claim 1 wherein said injector means comprises a push rod which connects with an element defining said wall and a retainer spring biases said wall toward said pin means.

3. The clutch mechanism of claim 2 wherein said concave arcuate surface is symmetric about a central axis through said rod.

4. The clutch mechanism of claim 3 wherein said concave arcuate surface extends along approximately 100° of an arc defined by the sliding engagement of said pin means with said concave arcuate surface.

5. The clutch mechanism of claim 2 wherein said first and second coupling means are rotatable about a first axis and said pin means comprises a coupling pin slidably displaceable along a second axis which is generally orthogonal to said first axis between an engaged and a non-engaged position.

6. The clutch mechanism of claim 5 further comprising spring means for biasing said coupling pin to the non-engaged position.

7. The clutch mechanism of claim 6 wherein the biasing force of said spring means is less than the biasing force of said retainer spring.

8. The clutch mechanism of claim 1 wherein when said latch is unlocked, said latch is released by said pin means slidably moving along said concave arcuate surface.

9. A lock system for a door comprising:

a lockset comprising a projectable and retractable lockable latch and an actuator for operating said latch;

first coupling means rotatable about a first axis for translating rotational movement applied to said actuator;

second coupling means comprising a handle and an assembly rotatable about said first axis; and clutch means for selectively engaging said first and second coupling means, said clutch means comprising:

pin means carried by said first or second coupling means in fixed rotational relationship thereto;

receiving means in the other of said first or second coupling means for receiving said pin means;

injector means for moving said pin means into said receiving means, said injector means comprising a movable wall having a concave arcuate surface, said injector means movable between a locked position where said pin means is not received in said receiving means and an unlocked position where said pin means is received in said receiving means thereby rotationally coupling said first and second coupling means; and drive means for driving said injector means between said first and second positions, said drive means comprising a motor and a drive link comprising a spring shaft drivable by said motor, wherein rotation of said handle when said injector means is in the unlocked position causes rotation of said first coupling means, said pin means slides along said concave arcuate surface, and the rotational movement of said first coupling means is translated to said actuator, whereby said latch is retracted.

10. The lock system of claim 9 wherein said injector means comprises a rod and said concave arcuate surface is generally symmetric about an axis through said rod.

11. A lock system for a door comprising:

a lockset comprising a projectable and retractable lockable latch and an actuator for operating said latch;

an entry control which receives an input and generates an output in response to a valid input;

a first coupler which translates rotational motion to said actuator;

a second coupler comprising a rotatable assembly which selectively translates rotational motion;

a clutch assembly which selectively engages said first and second couplers, said clutch assembly comprising:

an injector having a concave arcuate shoulder and a biasing spring;

a drive unit responsive to said output which drives said injector such that said injector is movable between first and second positions to selectively rotatably engage said first coupler and second coupler for selectively locking and unlocking said latch, said drive unit comprising a drive link unit comprising a spring shaft;

an engagement member carried by said first coupler in fixed rotational relationship therewith for selectively engaging said second coupler, said engagement member rotatable along a shear path defined by said concave arcuate shoulder, and spring means for biasing said engagement member to the non-engaged position, wherein said injector biasing spring biases said injector toward said engagement member.

12. The lock system of claim 11, wherein the biasing force of said injector biasing spring is greater than the biasing force of said spring means.

* * * * *